US012066031B2

(12) United States Patent
Lin et al.

(10) Patent No.: US 12,066,031 B2
(45) Date of Patent: Aug. 20, 2024

(54) FAN MODULE

(71) Applicant: ASUSTeK COMPUTER INC., Taipei (TW)

(72) Inventors: Hsin-Chen Lin, Taipei (TW); Ing-Jer Chiou, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 18/297,632

(22) Filed: Apr. 9, 2023

(65) Prior Publication Data

US 2024/0102483 A1 Mar. 28, 2024

(30) Foreign Application Priority Data

Sep. 26, 2022 (TW) ..... 111136338

(51) Int. Cl.
*F04D 25/08* (2006.01)
*F04D 29/18* (2006.01)

(52) U.S. Cl.
CPC ..... *F04D 29/181* (2013.01); *F04D 25/08* (2013.01)

(58) Field of Classification Search
CPC ..... F04D 29/181; F04D 25/08
USPC ..... 416/179
See application file for complete search history.

(56) References Cited

U.S. PATENT DOCUMENTS 10,001,128 B2 * 6/2018 Lin ..... F04D 29/023
10,487,845 B2 * 11/2019 Yang ..... B21D 53/267
10,677,258 B2 * 6/2020 Tamaoka ..... G06F 1/203
11,286,947 B2 * 3/2022 Horng ..... F04D 29/542
2013/0259666 A1 * 10/2013 Wong ..... F04D 29/162 415/183
2014/0219789 A1 * 8/2014 Horng ..... F04D 29/162 415/206
2015/0152883 A1 * 6/2015 Dybenko ..... F04D 25/0613 415/220
2016/0273546 A1 * 9/2016 Chan ..... F04D 29/281
2018/0238338 A1 * 8/2018 Tamaoka ..... F04D 29/162
2019/0301485 A1 * 10/2019 Chen ..... F04D 25/08

FOREIGN PATENT DOCUMENTS

CN 100357609 12/2007
CN 107975482 5/2018
CN 109268313 1/2019
CN 111120399 5/2020
TW 201341670 10/2013
TW 201341670 A * 10/2013 ..... F04D 29/26

* cited by examiner

*Primary Examiner* — Hung Q Nguyen
*Assistant Examiner* — Anthony Donald Taylor, Jr.
(74) *Attorney, Agent, or Firm* — JCIPRNET

(57) ABSTRACT

A fan module includes a hub, a plurality of fan blades, and a ring frame. The hub is configured to rotate about a central axis. The plurality of fan blades surround the hub. Each of the plurality of fan blades includes a first end portion connected to the hub and a second end portion opposite to the first end portion. The ring frame is connected to the second end portion of each of the plurality of fan blades. The ring frame includes a first surface facing the plurality of fan blades and a second surface opposite to the first surface, and the first surface is a curved surface.

11 Claims, 12 Drawing Sheets

FAN MODULE

CROSS-REFERENCE TO RELATED APPLICATION

This application claims the priority benefit of Taiwan application serial no. 111136338, filed on Sep. 26, 2022. The entirety of the above-mentioned patent application is hereby incorporated by reference herein and made a part of this specification.

BACKGROUND

Technical Field

The disclosure relates to a fan module.

Description of Related Art

Generally speaking, a rotor of a fan includes a plurality of blades connected to a central hub. As electronic products have evolved to become lighter and thinner, the volumes of fans installed in electronic products to be used for heat dissipation for electronic components also become smaller. As a result, the spacing between the blades becomes smaller, and the thickness decreases as well. However, as a consequence of the decreased thickness of the blades, there comes the problem of structural strength insufficiency. If a frame is installed to strengthen the blades, then the airflow is affected, and thus the performance of the fan is affected.

SUMMARY

According to an aspect of this disclosure, a fan module is provided. The fan module includes a hub, a plurality of fan blades, and a ring frame. The hub is configured to rotate about a central axis. The plurality of fan blades surround the hub. Each of the plurality of fan blades includes a first end portion connected to the hub and a second end portion opposite to the first end portion. The ring frame is connected to the second end portion of each of the plurality of fan blades, and the ring frame includes a first surface facing the plurality of fan blades and a second surface opposite to the first surface, and the first surface is a curved surface.

Based on the above, the ring frame of the fan module of the disclosure is connected to the outer endpoint of each of the fan blades, thereby strengthening the structural strength of the fan blades and reducing the situation that the fan blades are easily deformed or even broken due to the thinness of the fan blades. Moreover, the ring frame is designed in such a way that the camber of the inner surface facing the fan blades is larger, and the camber of the outer surface is gentler. This configuration can form a pressure difference between the inner surface facing the fan blades and the opposing outer surface of the ring frame, thereby promoting the airflow and improving the performance of the fan module. Therefore, the fan module of the disclosure can improve or at least maintain the performance of the fan module while strengthening the structural strength of the fan blades.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
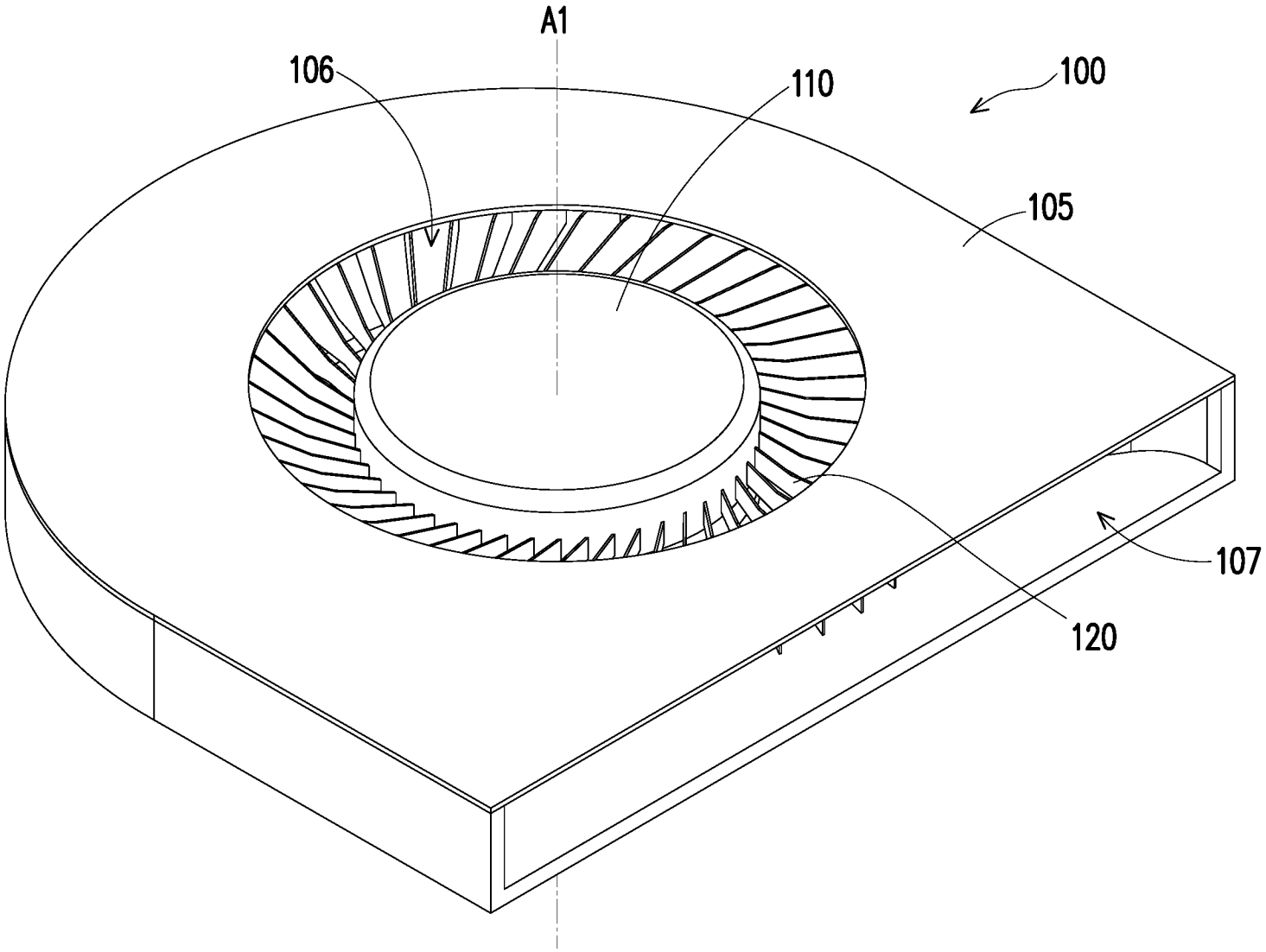
FIG. 1 is a schematic perspective view of a fan module according to an embodiment of the disclosure.

Regarding the aforementioned and other technical contents, features and advantages of the disclosure, they are to be described more comprehensively with each embodiment accompanied with reference figures hereinafter. In the following embodiments, wordings used to indicate directions, such as "up," "down," "front," "back," "left", and "right", merely refer to directions in the accompanying drawings. Therefore, the wordings used to indicate directions are used to illustrate rather than to limit the disclosure. Also, in each of the following embodiments, the same or similar reference numerals or labels represent the same or similar components.

Figure 2:
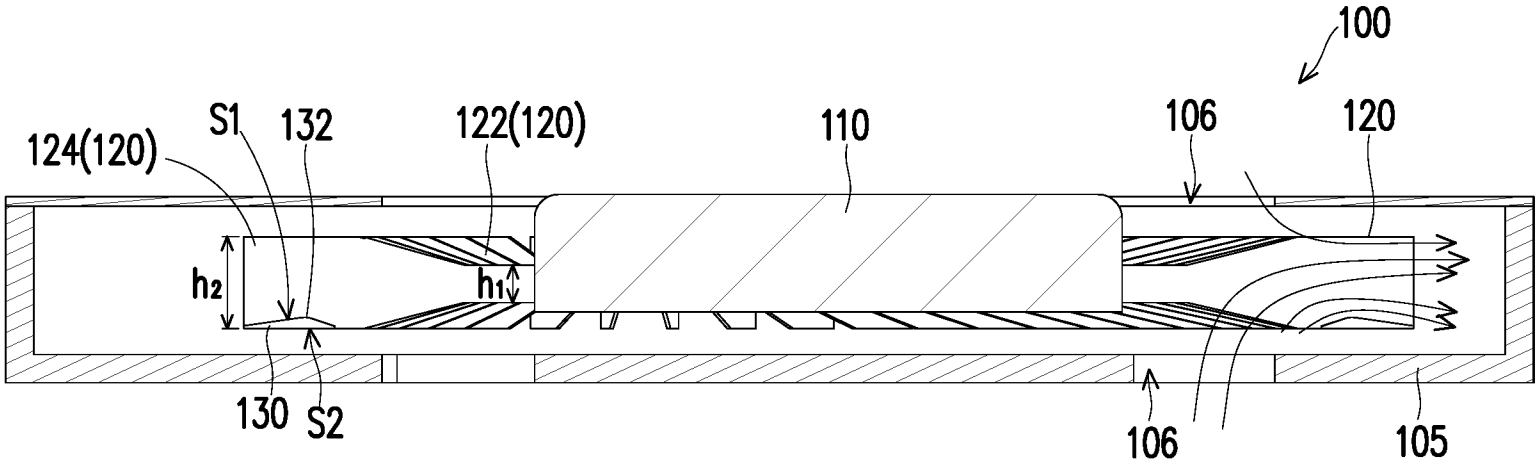
FIG. 2 is a schematic cross-sectional view of a fan module according to an embodiment of the disclosure.

FIG. 1 is a schematic perspective view of a fan module according to an embodiment of the disclosure. FIG. 2 is a schematic cross-sectional view of a fan module according to an embodiment of the disclosure. Please refer to FIG. 1 and FIG. 2 simultaneously. In some embodiments, the fan module 100 includes a casing 105, a hub 110, a plurality of fan blades 120, and a ring frame 130. The hub 110 is disposed in the casing 105 and exposed to the outside through an opening of the casing 105. The hub 110 is configured to rotate about a central axis A1 of the fan module 100. The plurality of fan blades 120 are respectively disposed around the hub 110 to rotate about the central axis A1 when driven by the hub 110. In some embodiments, the casing 105 may include an air inlet 106 and an air outlet 107. In this embodiment, the air inlets 106 can be located on the upper and lower sides of the casing 105, and the air outlet 107 can be located on a side of the casing 105. In this way, the fan module 100 can use the air inlets 106 on the upper and lower sides to draw in the airflow from the outside, and use the air outlet 107 located on the side to send out air sideways. Of course, this embodiment is only an example, and the disclosure is not intended to limit the configuration of the air inlet and the air outlet of the fan module.

In some embodiments, each of the fan blades 120 may include a first end portion 122 and a second end portion 124 opposite to each other. The first end portions 122 are respectively connected to an outer side surface of the hub 110, and the second end portions 124 are opposite to the first end portions 122. In this embodiment, a thickness h1 of the first end portion 122 may be smaller than a thickness h2 of the second end portion 124. Specifically speaking, the thickness h1 of the part connecting the hub 110 in the first end portion 122 is approximately smaller than the thickness h2 of the second end portion 124, but the disclosure is not limited thereto.

Figure 3:
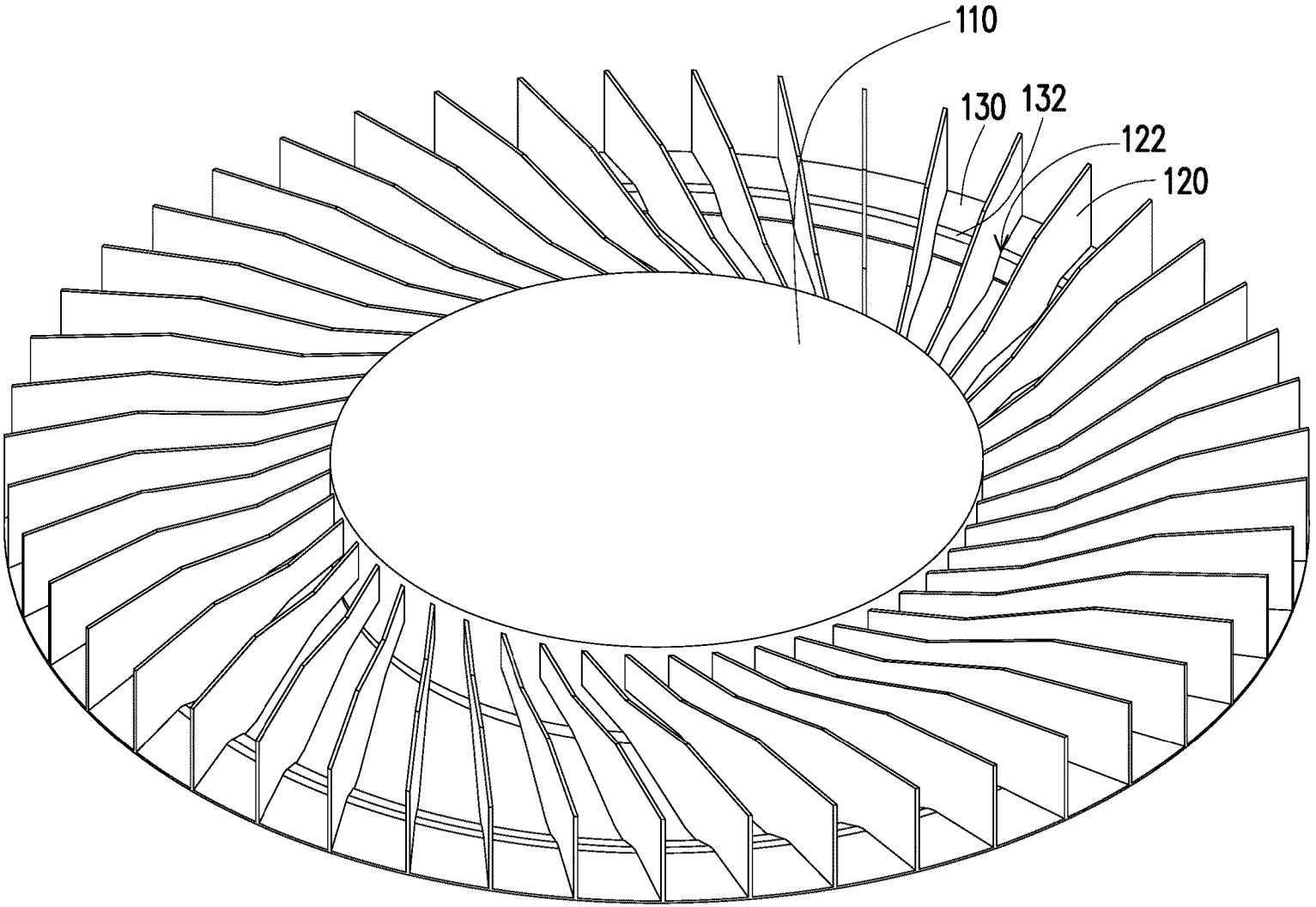
FIG. 3 is a schematic perspective view of some components of a fan module according to an embodiment of the disclosure.
Figure 4:
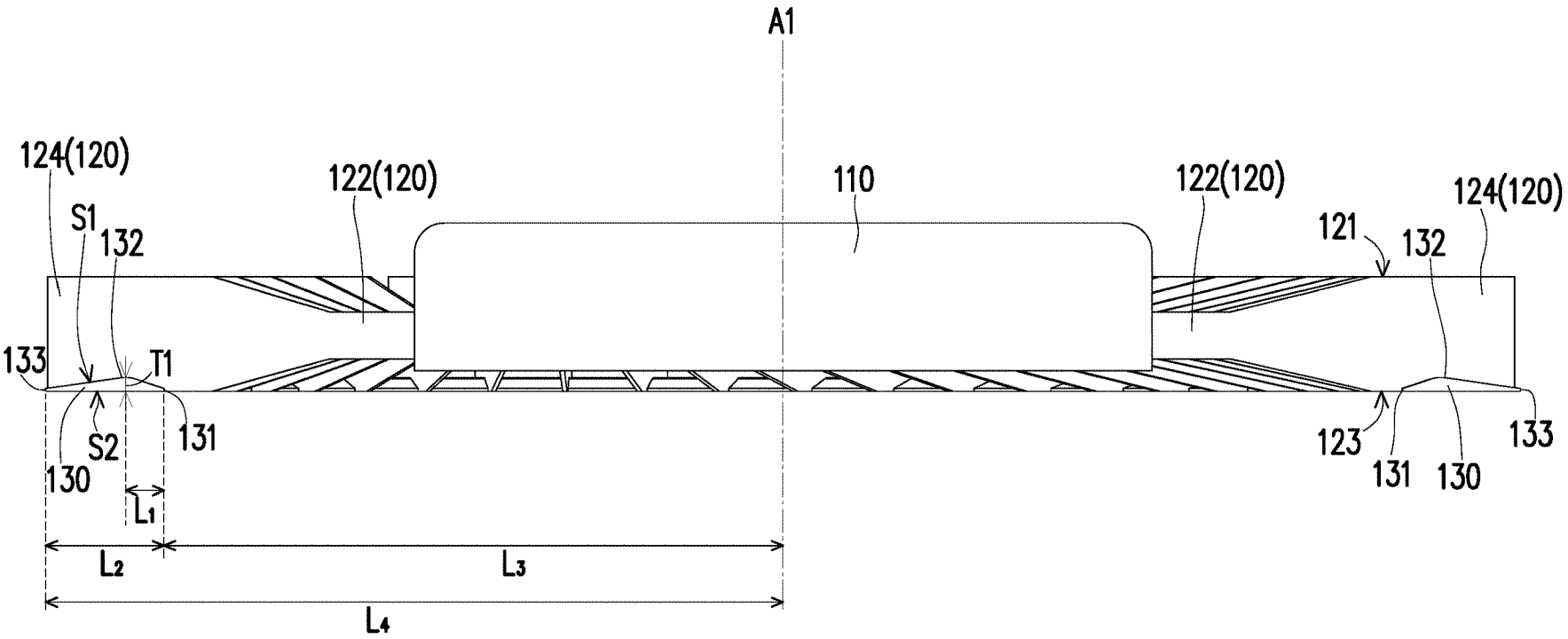
FIG. 4 is a schematic cross-sectional view of some components of a fan module according to an embodiment of the disclosure.

FIG. 3 is a schematic perspective view of some components of a fan module according to an embodiment of the disclosure. FIG. 4 is a schematic cross-sectional view of some components of a fan module according to an embodiment of the disclosure. It should be noted that, in order to show the internal structure of the fan module more clearly, the illustration of the casing 105 of the fan module is omitted from FIG. 3 to FIG. 12. Please refer to FIG. 2 to FIG. 4 simultaneously. In some embodiments, the ring frame 130 surrounds the outer edge of each of the plurality of fan blades 120, and is connected to the second end portion 124 of each of the fan blades 120, wherein the ring frame 130 includes a first surface S1 facing the fan blades 120 and a second surface S2 opposite to the first surface S1, and the first surface S1 is a curved surface as shown in FIG. 4. In this embodiment, the first surface S1 is a curved surface protruding towards the second end portion 124, and the second surface S2 is a plane surface (with zero camber). In other embodiments, the second surface S2 can also be a curved surface or an inclined surface, as long as the surface area of the first surface S1 is approximately larger than the surface area of the second surface S2, or the camber of the first surface S1 is approximately larger than the camber of the second surface S2.

In such a configuration, the ring frame 130 is connected to the second end portion 124 of each of the fan blades 120, thereby strengthening the structural strength of the fan blades 120 and reducing the situation that the fan blades 120 are easily deformed or even broken due to the thinness of the fan blades. In addition, the ring frame 130 is designed in such a way that the first surface S1 has a larger camber and the second surface S2 has a gentler camber. Therefore, when the airflow flows through the second surface S2 with a smaller camber, the speed does not increase too much. Accordingly, the airflow pressure is not reduced too much. In contrast, when the airflow flows through the first surface S1 with a larger camber, the speed increases a lot, so the airflow pressure decreases a lot. This configuration can form a pressure difference between the first surface S1 (facing the inner surface of the fan blades 120) and the second surface S2 (facing the outer surface) of the ring frame 130, thereby promoting the airflow and improving the performance of the fan module 100. Therefore, the fan module 100 can improve or at least maintain the performance of the fan module 100 while strengthening the structural strength of the fan blades 120.

Please refer to FIG. 4. Specifically speaking, in some embodiments, the ring frame 130 may include an inner edge 131 and an outer edge 133 opposite to each other, wherein the inner edge 131 is close to the first end portion 122 of each of the fan blades 120, and the outer edge 133 is close to the second end portion 124 of each of the fan blades 120. In this embodiment, the thickness of the inner edge 131 and the thickness of the outer edge 133 are both smaller than the maximum thickness T1 of the ring frame 130 at the peak point 132 of the curved surface. In this embodiment, the ring frame 130 is disposed on the lower side of the fan blades 120. Specifically speaking, the ring frame 130 is connected to the lower surface 123 of each of the fan blades 120. The lower surface 123 of each of the fan blades 120 may have a notch corresponding to the curved first surface S1 of the ring frame 130, so that the ring frame 130 is fitted with the lower surface 123 of each of the fan blades 120. Moreover, in this embodiment, the second surface S2 of the ring frame 130 can be coplanar with the lower surface 123 of each of the fan blades 120 to reduce wind resistance.

In one embodiment, the maximum thickness T1 of the ring frame 130 (e.g., the thickness at the peak point 132) is at least three times the minimum thickness of the ring frame 130 (e.g., the thickness of the inner edge 131 and the thickness of the outer edge 133). In some embodiments, the shortest distance L1 from the peak point 132 to the inner edge 131 of the ring frame 130 is 28% to 38% of the shortest distance L2 from the inner edge 131 to the outer edge 133. In one embodiment, the shortest distance L2 from the inner edge 131 to the outer edge 133 is at least five times the maximum thickness T1 of the ring frame 130 (e.g., the thickness at the peak point 132) (i.e., L2>5T1). In one embodiment, the outer endpoint of each of the fan blades 120 is connected to one another to define a circle, and the inner radius (half of the inner diameter) L3 of the ring frame 130 is substantially larger than 75% of the radius L4 of the circle defined by the outer endpoint of each of the fan blades 120 (i.e., L3>75% of L4). Experiments have confirmed that under the range of sizes mentioned above, the turbulence of the ring frame 130 can be minimized, and even the gas flow can be promoted, so that the performance of the fan module 100 can be optimized. The dimensional configurations described above are applicable to all embodiments of the disclosure.

Figure 5:
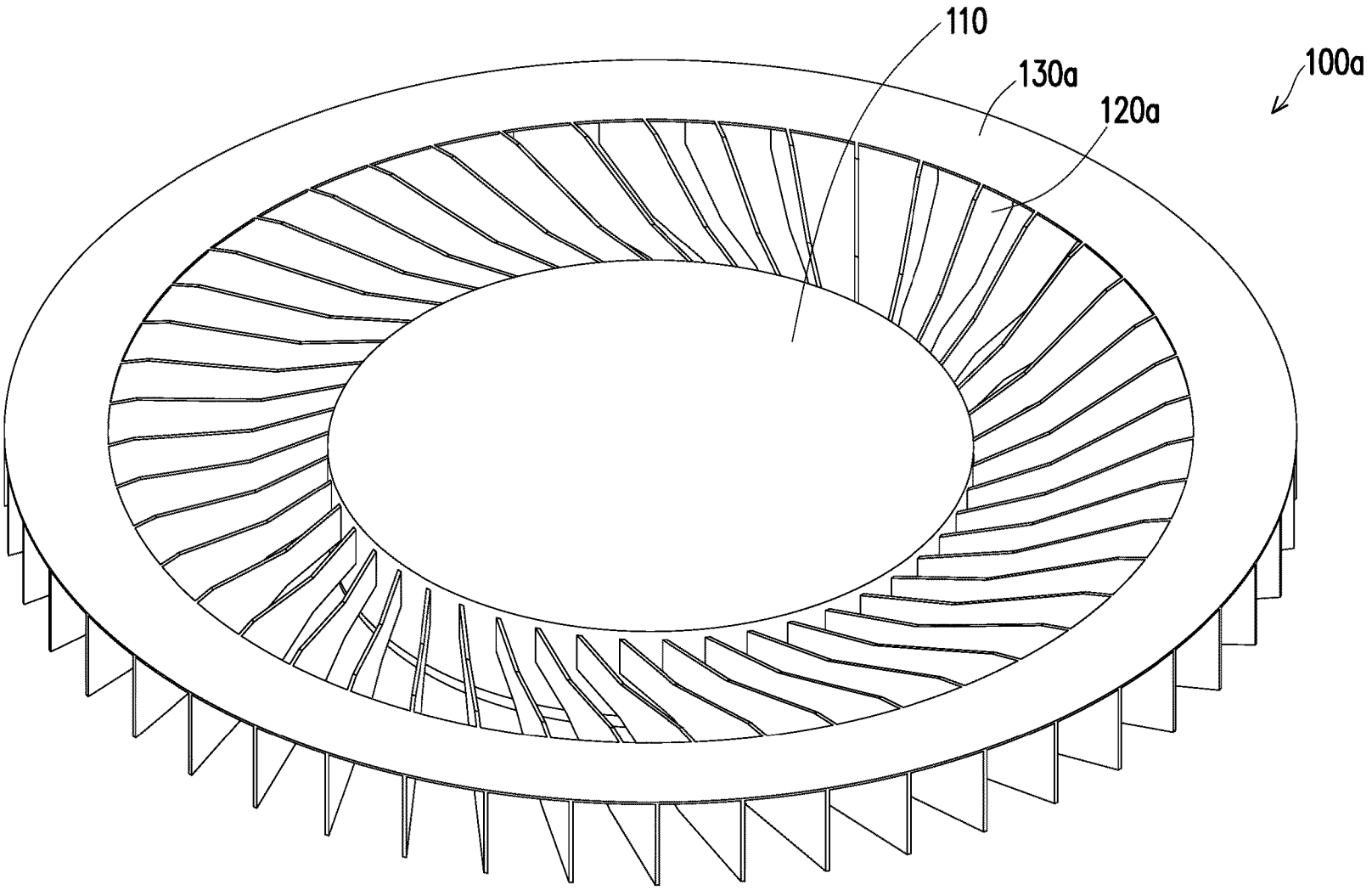
FIG. 5 is a schematic perspective view of a fan module according to an embodiment of the disclosure.
Figure 6:
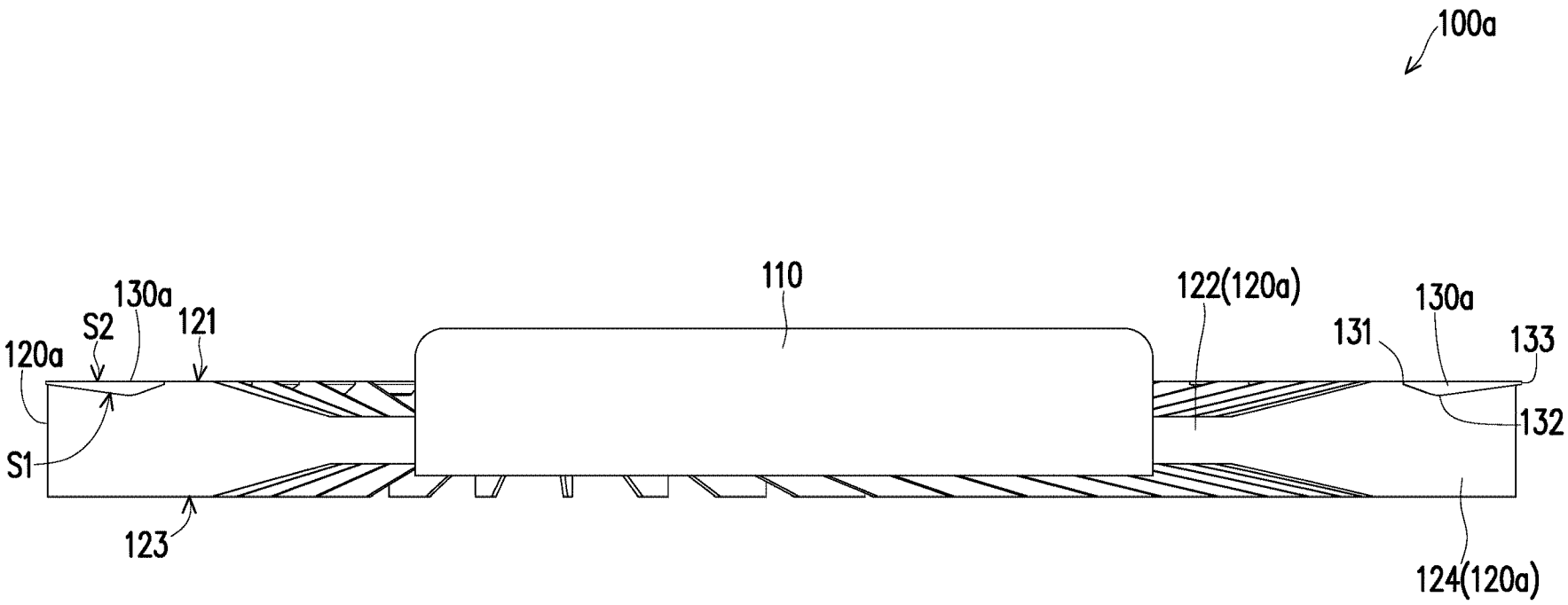
FIG. 6 is a schematic cross-sectional view of a fan module according to an embodiment of the disclosure.

FIG. 5 is a schematic perspective view of a fan module according to an embodiment of the disclosure. FIG. 6 is a schematic cross-sectional view of a fan module according to an embodiment of the disclosure. It should be noted here that the fan module **100*a* of this embodiment is similar to the fan module 100 of the previous embodiment. Therefore, this embodiment uses the reference numerals and part of the content of the previous embodiment. The same reference numerals are used to denote the same or similar components, and the description of the same technical contents is omitted. For the description of the omitted part, reference may be made to the aforementioned embodiments, which will not be repeated in this embodiment. The following will describe the differences between the fan module 100*a* of this embodiment and the fan module 100** of the previous embodiment.

Please refer to FIG. 5 and FIG. 6 simultaneously. In this embodiment, the ring frame 130 is disposed on the upper side of the fan blades 120. Specifically speaking, the ring frame 130 is connected to the upper surface 121 of each of the fan blades 120. In this embodiment, the lower surface 121 of each of the fan blades **120*a* may have a notch corresponding to the curved first surface S1 of the ring frame 130*a*, so that the ring frame 130*a* is fitted with the upper surface 121 of each of the fan blades 120*a*. Moreover, in this embodiment, the second surface S2 of the ring frame 130*a* can be coplanar with the upper surface 121 of each of the fan blades 120*a*** to reduce wind resistance.

Figure 7:
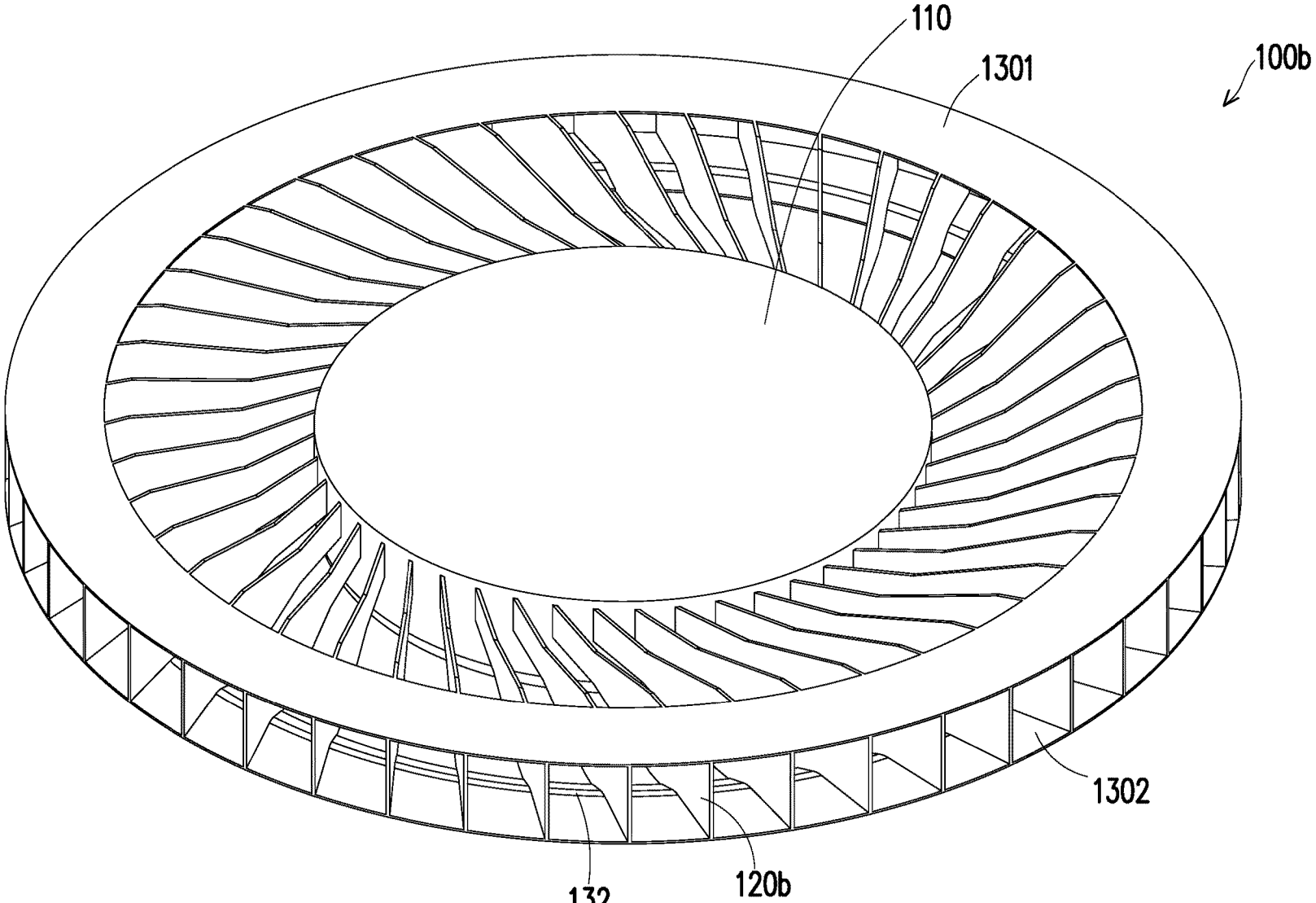
FIG. 7 is a schematic perspective view of a fan module according to an embodiment of the disclosure.
Figure 8:
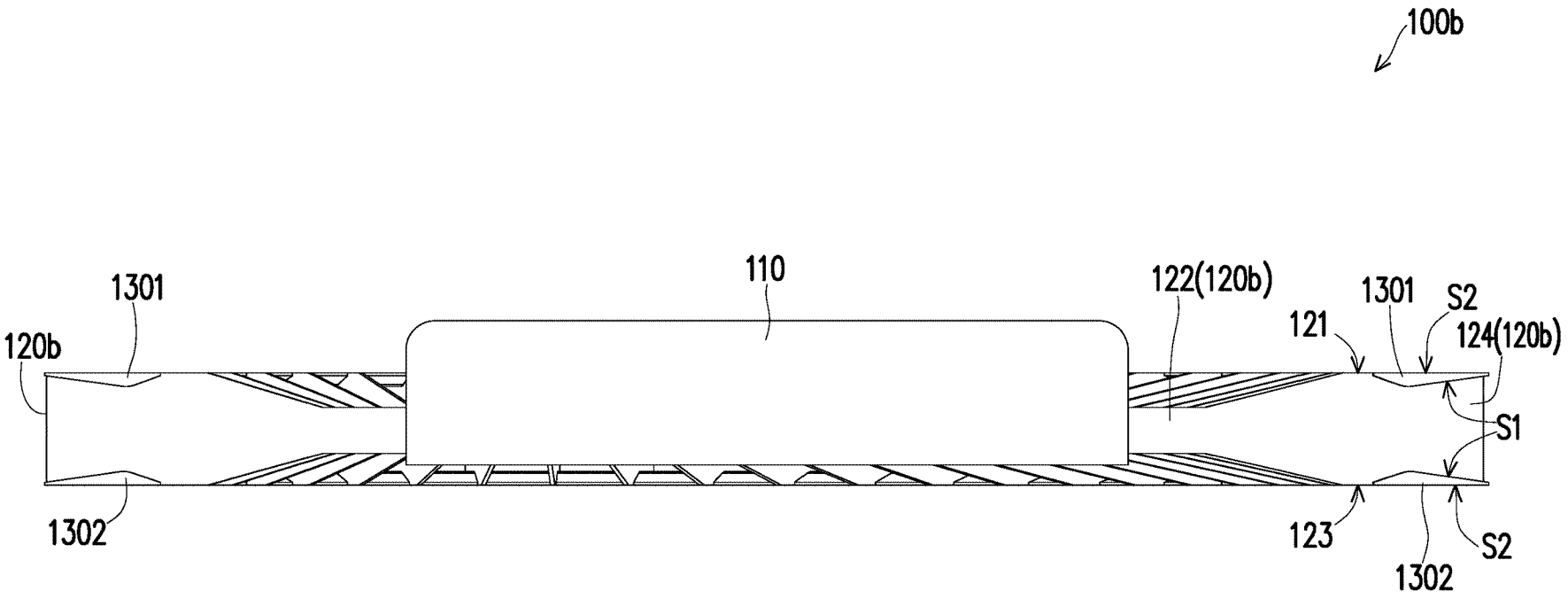
FIG. 8 is a schematic cross-sectional view of a fan module according to an embodiment of the disclosure.

FIG. 7 is a schematic perspective view of a fan module according to an embodiment of the disclosure. FIG. 8 is a schematic cross-sectional view of a fan module according to an embodiment of the disclosure. It should be noted here that the fan module 100*b* of this embodiment is similar to the fan module 100 of the previous embodiment. Therefore, this embodiment uses the reference numerals and part of the content of the previous embodiment. The same reference numerals are used to denote the same or similar components, and the description of the same technical contents is omitted. For the description of the omitted part, reference may be made to the aforementioned embodiments, which will not be repeated in this embodiment. The following will describe the differences between the fan module 100*b* of this embodiment and the fan module of the previous embodiment.

In this embodiment, the ring frame 130*b* may include a first ring frame 1301 and a second ring frame 1302. The first ring frame 1301 and the second ring frame 1302 can be disposed on the upper and lower surfaces of each of the fan blades 120*b* respectively. That is to say, the first ring frame 1301 is connected to the upper surface 121 of each of the fan blades 120*b*, and the second ring frame 1302 is connected to the lower surface 123 of each of the fan blades 120*b*. Specifically speaking, the first ring frame 1301 is connected to the upper surface 121 of each of the fan blades 120*b* located in the second end portion 124, and the second ring frame 1302 is connected to the lower surface 123 of each of the fan blades 120*b* located in the second end portion 124. In one embodiment, when viewed from the direction of the top view, the positions where the first ring frame 1301 and the second ring frame 1302 are disposed may approximately coincide or at least partially overlap. In this embodiment, the upper surface 121 and the lower surface 123 of each of the fan blades 120*b* may have a notch corresponding to the curved surface (the first surface S1) of the first ring frame 1301 and the second ring frame 1302, so that the first ring frame 1301 is fitted with the upper surface 121 of each of the fan blades 120*b*, and the second ring frame 1302 is fitted with the lower surface 123 of each of the fan blades 120*b*. In addition, in this embodiment, the outer surface (the second surface S2) of the first ring frame 1301 may be coplanar with the upper surface 121 of each of the fan blades 120*b*, and the outer surface (the second surface S2) of the second ring frame 1302 may be coplanar with the lower surface 123 of each of the fan blades 120*b* to reduce wind resistance.

Figure 9:
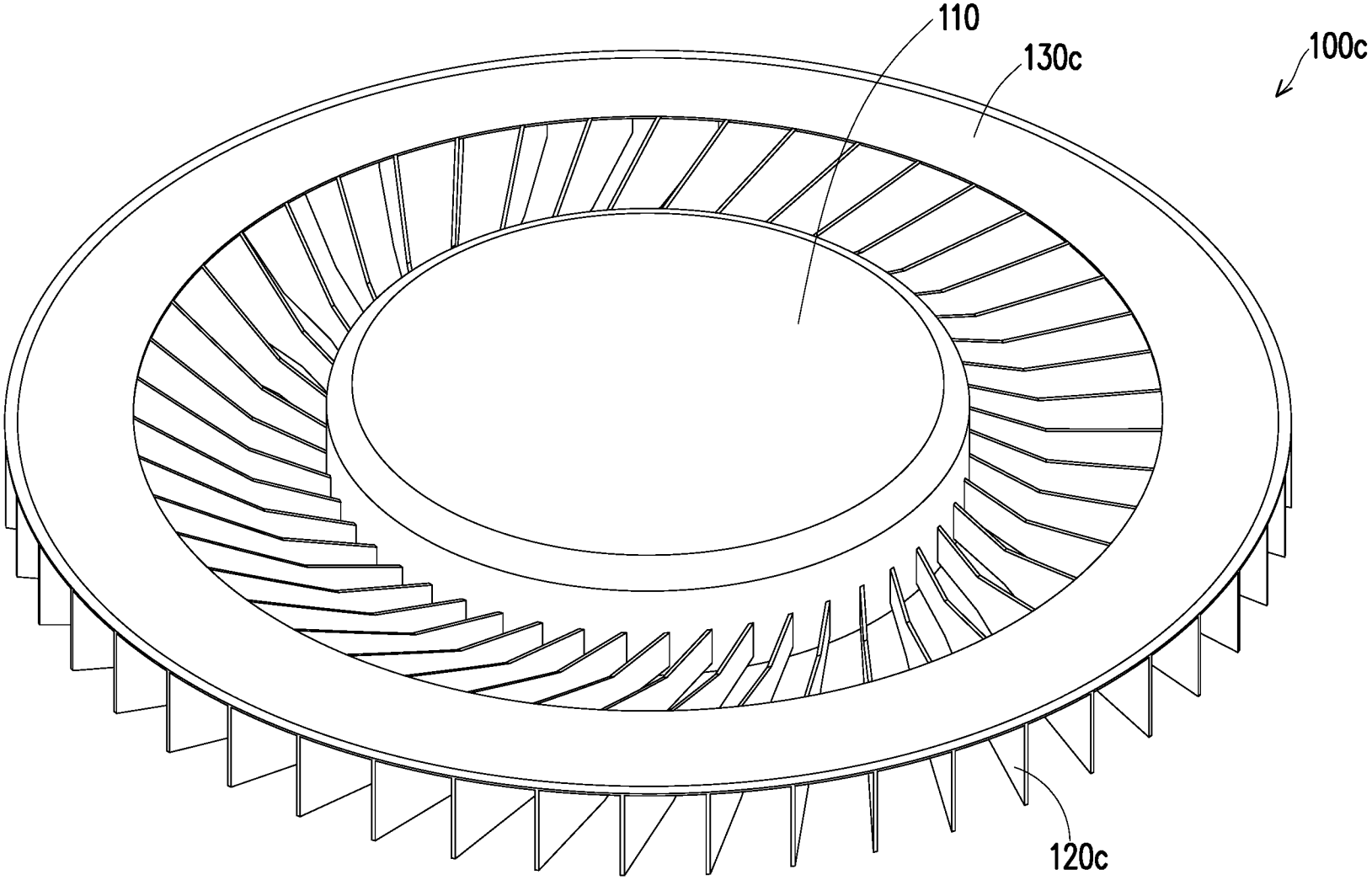
FIG. 9 is a schematic perspective view of a fan module according to an embodiment of the disclosure.
Figure 10:
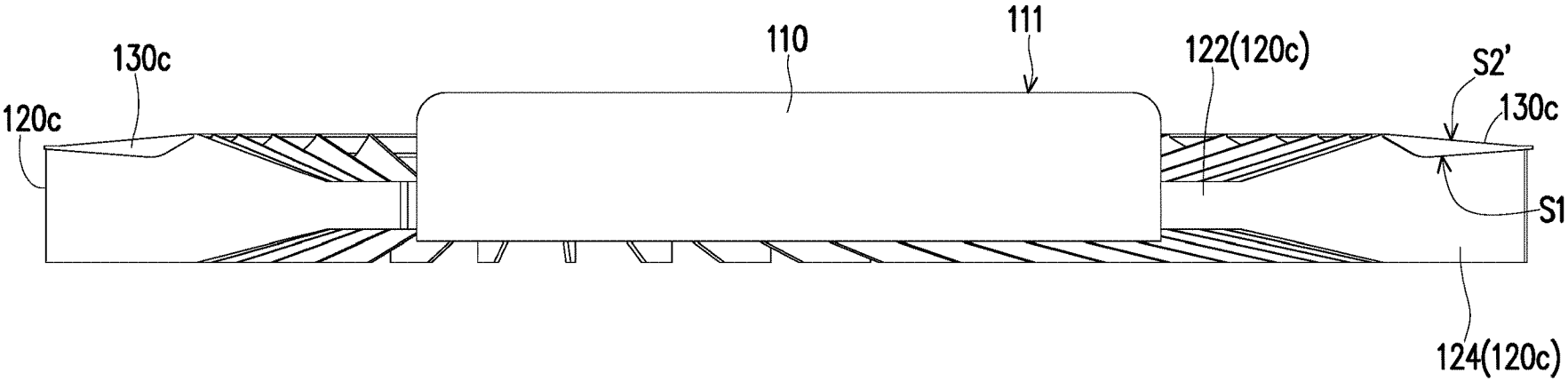
FIG. 10 is a schematic cross-sectional view of a fan module according to an embodiment of the disclosure.

FIG. 9 is a schematic perspective view of a fan module according to an embodiment of the disclosure. FIG. 10 is a schematic cross-sectional view of a fan module according to an embodiment of the disclosure. It should be noted here that the fan module 100*c* of this embodiment is similar to the fan module of the previous embodiment. Therefore, this embodiment uses the reference numerals and part of the content of the previous embodiment. The same reference numerals are used to denote the same or similar components, and the description of the same technical contents is omitted. For the description of the omitted part, reference may be made to the aforementioned embodiments, which will not be repeated in this embodiment. The following will describe the differences between the fan module 100*c* of this embodiment and the fan module of the previous embodiment.

Please refer to FIG. 9 and FIG. 10 simultaneously. In this embodiment, the second surface S2' of the ring frame 130*c* may be an inclined surface. Specifically speaking, the first surface S1 of the ring frame 130*c* is a curved surface protruding towards each of the fan blades 120*c*, and the second surface S2' opposite to the first surface S1 may be a plane surface. Furthermore, the second surface S2' may be inclined with respect to the upper surface 111 of the hub 110. In this embodiment, the ring frame 130*c* is disposed on the upper surface of each of the fan blades 120*c*. However, in other embodiments, the ring frame 130*c* with an inclined outer surface (the second surface S2') may also be disposed on the lower surface of each of the fan blades 120*c*, or may also be disposed respectively on both the upper and lower surfaces of each of the fan blades 120*c*. The slope of the inclined outer surface (the second surface S2') of the ring frame 130*c* may be adjusted according to the practical needs of the airflow design, and the disclosure is not limited thereto.

Figure 11:
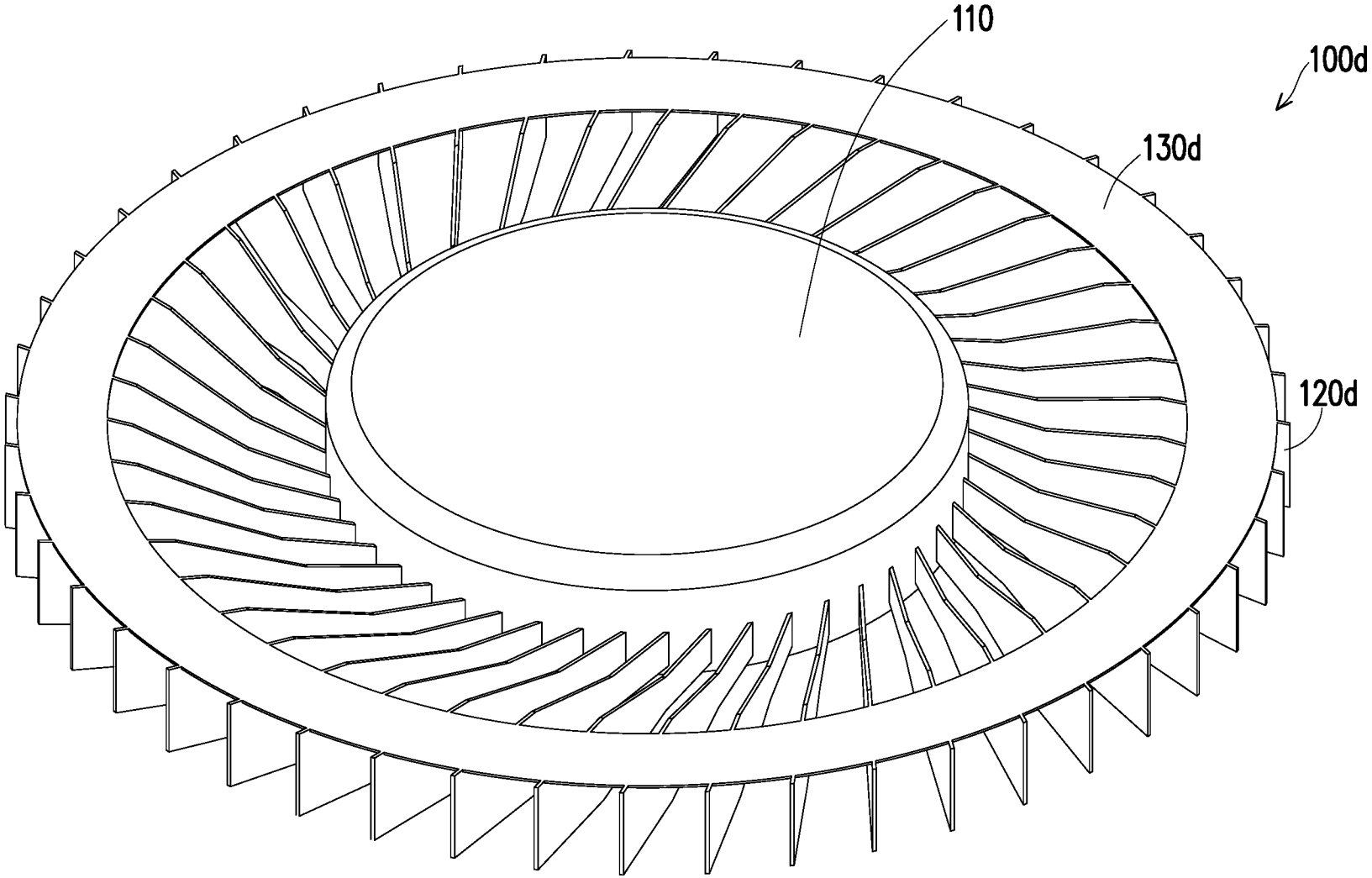
FIG. 11 is a schematic perspective view of a fan module according to an embodiment of the disclosure.
Figure 12:
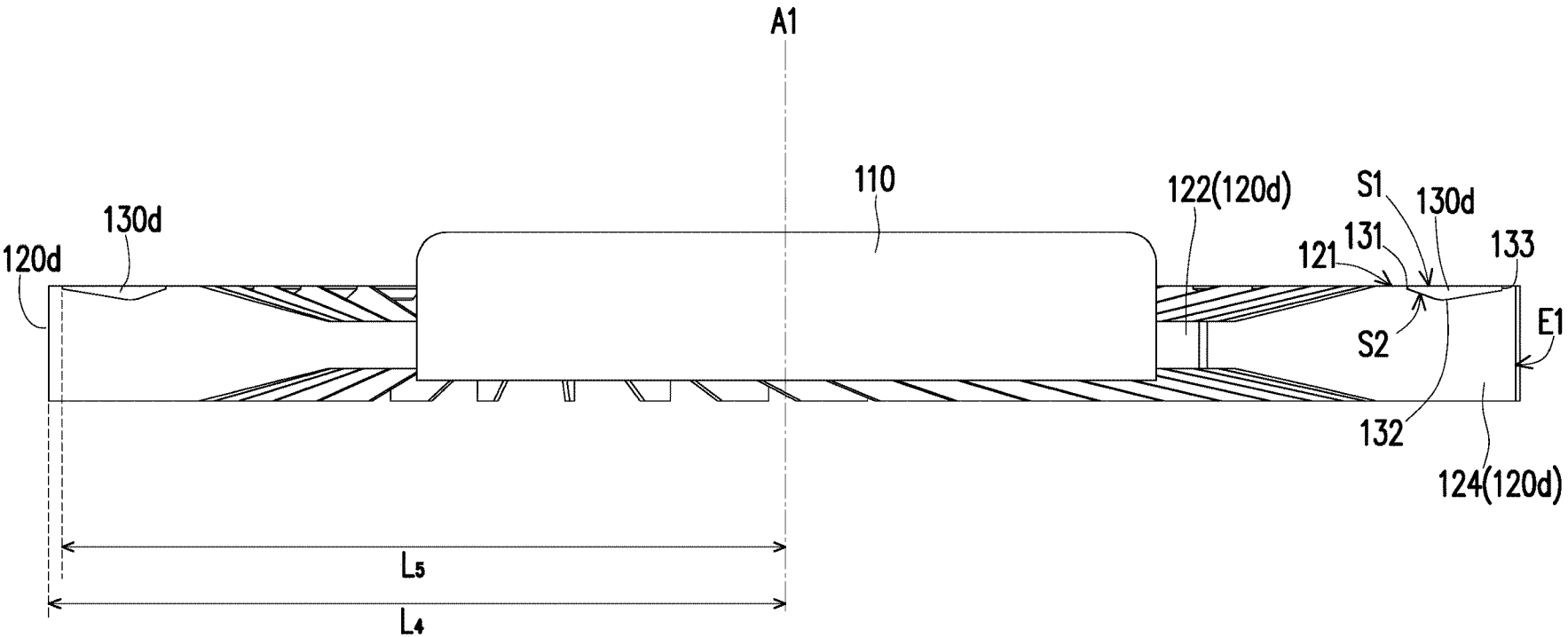
FIG. 12 is a schematic cross-sectional view of a fan module according to an embodiment of the disclosure.

FIG. 11 is a schematic perspective view of a fan module according to an embodiment of the disclosure. FIG. 12 is a schematic cross-sectional view of a fan module according to an embodiment of the disclosure. It should be noted here that the fan module 100 of this embodiment is similar to the fan module of the previous embodiment. Therefore, this embodiment uses the reference numerals and part of the content of the previous embodiment. The same reference numerals are used to denote the same or similar components, and the description of the same technical contents is omitted. For the description of the omitted part, reference may be made to the aforementioned embodiments, which will not be repeated in this embodiment. The following will describe the differences between the fan module 100*c* of this embodiment and the fan module of the previous embodiment.

Please refer to FIG. 11 and FIG. 12 simultaneously. In this embodiment, the outer edge 133 of the ring frame may not be aligned with the outer endpoint E1 of each of the fan blades 120*d*. In other words, when viewed from the direction of the top view, the outer edge 133 of the ring frame 130*d* may not coincide with the outer endpoint E1 of each of the fan blades 120*d*. Specifically speaking, the outer endpoint E1 of each of the fan blades 120*d* is connected to one another to define a circle, and the outer radius (half of the outer diameter) L5 of the ring frame 130*d* is approximately smaller than the radius L4 of the circle defined by the outer endpoint E1 of each of the fan blades 120*d*. In this embodiment, the upper surface 121 of each of the fan blades 120*d* may have a notch corresponding to the curved surface of the ring frame 130*d*, so that the ring frame 130*d* is fitted with the upper surface 121 of each of the fan blades 120*d*. Moreover, in this embodiment, the outer surface (the second surface S2) of the ring frame 130*d* can be coplanar with the upper surface 121 of each of the fan blades 120*d* to reduce wind resistance. In this embodiment, the ring frame 130*d* is disposed on the upper surface 121 of each of the fan blades 120*d*. However, in other embodiments, the ring frame 130*d* may also be disposed on the lower surface of each of the fan blades 120*d*, or may also be disposed respectively on both the upper and lower surfaces of each of the fan blades 120*d*, and the disclosure is not limited thereto.

In summary, the ring frame of the fan module of the disclosure is connected to the outer endpoint of each of the fan blades, thereby strengthening the structural strength of the fan blades and reducing the situation that the fan blades are easily deformed or even broken due to the thinness of the fan blades. Moreover, the ring frame is designed in such a way that the camber of the inner surface facing the fan blades is larger, and the camber of the outer surface is gentler. This configuration can form a pressure difference between the inner surface facing the fan blades and the opposing outer surface of the ring frame, thereby promoting the airflow and improving the performance of the fan module. Therefore, the fan module can improve or at least maintain the performance of the fan module while strengthening the structural strength of the fan blades.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A fan module, comprising:

a hub configured to rotate about a central axis;

a plurality of fan blades surrounding the hub, wherein each of the plurality of fan blades comprises a first end portion connected to the hub and a second end portion opposite to the first end portion; and a ring frame connected to the second end portion of each of the plurality of fan blades, wherein the ring frame comprises a first surface facing the plurality of blades and a second surface opposite to the first surface, the first surface is a curved surface, and the second surface is a plane surface or an inclined surface and is coplanar with at least one of a lower surface and an upper surface of each of the plurality of fan blades, wherein the ring frame further comprises an inner edge close to the first end portion and an outer edge close to the second end portion, and a thickness of the inner edge and a thickness of the outer edge are both smaller than a maximum thickness of the ring frame.

2. The fan module of claim 1, wherein a camber of the first surface is larger than a camber of the second surface.

3. The fan module of claim 1, wherein a distance from a peak point with the maximum thickness to the inner edge of the ring frame is 28% to 38% of a distance from the inner edge to the outer edge.

4. The fan module of claim 1, wherein the maximum thickness of the ring frame is at least three times a minimum thickness of the ring frame.

5. The fan module of claim 1, wherein a distance from the inner edge to the outer edge is at least five times the maximum thickness of the ring frame.

6. The fan module of claim 1, wherein an outer endpoint of each of the plurality of fan blades is connected to one another to define a circle, and an inner radius of the ring frame is larger than 75% of a radius of the circle.

7. The fan module of claim 1, wherein an outer endpoint of each of the plurality of fan blades is connected to one another to define a circle, and an outer radius of the ring frame is smaller than a radius of the circle.

8. The fan module of claim 1, wherein the ring frame comprises a first ring frame and a second ring frame, the first ring frame is connected to the upper surface of each of the plurality of fan blades, and the second ring frame is connected to the lower surface of each of the plurality of fan blades.

9. The fan module of claim 1, wherein a surface area of the first surface is larger than a surface area of the second surface.

10. A fan module, comprising:

a hub configured to rotate about a central axis;

a plurality of fan blades surrounding the hub, wherein each of the plurality of fan blades comprises a first end portion connected to the hub and a second end portion opposite to the first end portion; and a ring frame connected to the second end portion of each of the plurality of fan blades, wherein the ring frame comprises a first surface facing the plurality of fan blades and a second surface opposite to the first surface, the first surface is a curved surface, and the second surface is a plane surface or an inclined surface and is coplanar with at least one of a lower surface and an upper surface of each of the plurality of fan blades, wherein the ring frame further comprises an inner edge close to the first end portion and an outer edge close to the second end portion, and a thickness of the inner edge and a thickness of the outer edge are both smaller than a maximum thickness of the ring frame, and the maximum thickness of the ring frame is located between the outer edge and the inner edge.

11. A fan module, comprising:

a hub configured to rotate about a central axis;

a plurality of fan blades surrounding the hub, wherein each of the plurality of fan blades comprises a first end portion connected to the hub and a second end portion opposite to the first end portion; and a ring frame connected to the second end portion of each of the plurality of fan blades, wherein the ring frame comprises a first surface facing the plurality of fan blades and a second surface opposite to the first surface, the first surface is a curved surface, and the second surface is a plane surface or an inclined surface and is coplanar with at least one of a lower surface and an upper surface of each of the plurality of fan blades, wherein the ring frame further comprises an inner edge close to the first end portion and an outer edge close to the second end portion, and a thickness of the inner edge and a thickness of the outer edge are both smaller than a maximum thickness of the ring frame defined at a peak point of the curved surface.

* * * * *